US007992749B2

(12) United States Patent
Fidrych et al.

(10) Patent No.: US 7,992,749 B2
(45) Date of Patent: Aug. 9, 2011

(54) SUPPORT ELEMENT FOR A CARRY STRAP

(75) Inventors: Paul J. Fidrych, Portland, OR (US); Chris Helmsworth, Portland, OR (US)

(73) Assignee: Nike, Inc., Beaverton, OR (US)

( * ) Notice: Subject to any disclaimer, the term of this patent is extended or adjusted under 35 U.S.C. 154(b) by 1496 days.

(21) Appl. No.: 11/394,129

(22) Filed: Mar. 30, 2006

(65) Prior Publication Data

US 2007/0245526 A1 Oct. 25, 2007

(51) Int. Cl.
*A45F 3/04* (2006.01)

(52) U.S. Cl. ..... 224/264; 224/642

(58) Field of Classification Search ..... 224/264, 224/642; 2/460–461; 297/482
See application file for complete search history.

(56) References Cited

U.S. PATENT DOCUMENTS

| | | | | |
|---|---|---|---|---|
| 4,887,318 | A * | 12/1989 | Weinreb | 2/268 |
| 5,018,652 | A * | 5/1991 | Holtzclaw, Jr. | 224/150 |
| 5,168,576 | A * | 12/1992 | Krent et al. | 2/456 |
| 5,250,345 | A * | 10/1993 | Chu | 428/156 |
| 6,318,609 | B1 * | 11/2001 | Swierz | 224/264 |
| 7,004,363 | B2 * | 2/2006 | Fenton et al. | 224/264 |
| 2004/0185247 | A1 * | 9/2004 | Fenton et al. | 428/327 |

FOREIGN PATENT DOCUMENTS

| | | |
|---|---|---|
| WO | 91045495 A | 5/1991 |
| WO | 2005000245 | 1/2005 |
| WO | 2005072557 A | 8/2005 |

OTHER PUBLICATIONS

International Search Report and Written Opinion for International Application No. PCT/US2007/007992, mailed Oct. 7, 2009, 16 pages.
International Preliminary Report on Patentability for International Application No. PCT/US2007/007992, mailed Oct. 22, 2009, 8 pages.

* cited by examiner

*Primary Examiner* — Tri M Mai
(74) *Attorney, Agent, or Firm* — Banner & Witcoff, Ltd.

(57) ABSTRACT

A strap has an extension element and a support element. The extension element joins with an article, such as a bag, backpack, or purse. The support element is secured to the extension element and has a plurality of sipes that enhance the flexibility of the strap. In another configuration, the support element has a central area formed from a foam that is more compressible than a foam forming end areas. In yet another configuration, the support element has a wedge-shaped cross-section.

4 Claims, 8 Drawing Sheets

SUPPORT ELEMENT FOR A CARRY STRAP

BACKGROUND

A variety of articles incorporate carry straps that assist with carrying the article. For example, a backpack generally incorporates a pair of straps that are configured to extend over both shoulders of an individual. Whereas the backpack often incorporates two straps, a messenger-style bag generally includes a single strap that extends over only one shoulder of the individual. Similarly, a golf bag conventionally includes either one strap or two straps that assist the individual with carrying golf equipment. Although some carry straps extend over or contact a shoulder, other carry straps contact a hand or other portions of an individual. For example, a handbag or purse may incorporate strap that is intended to be grasped by the hand. Accordingly, different types of articles may incorporate a variety of shoulder strap configurations.

One consideration in the design of a carry strap relates to comfort. In order to enhance the comfort of a strap, compressible materials are often incorporated into the strap in areas that contact the individual, such as the shoulder. An advantage of compressible materials in a strap relates to decreased pressure concentrations on the shoulders of the individual, and particularly in areas of the shoulder that include the suprascapular nerve. When a strap extends over the shoulder, some areas of the shoulder experience greater loads than other areas of the shoulder, thereby forming pressure concentrations in the areas of greater loads. Compressible materials may be utilized, therefore, to distribute loads more evenly over a surface of the shoulder and decrease the pressure concentrations.

Examples of compressible materials suitable for strap applications include polymer foams and fluid-filled bladders. U.S. Pat. No. 3,964,653 to Strutz discloses a padded carry strap incorporating a combination of materials that include foam, a webbing material, and synthetic leather, for example. In addition, U.S. Pat. No. 6,915,932 to Wolfe discloses a strap having a foam element and a fluid-filled bladder. The foam element defines various indentations, and the bladder is positioned within the indentations such that a combination of the foam element and the bladder provides cushioning when carrying an article. Other references disclosing straps with fluid-filled members include U.S. Pat. No. 6,223,959 to Chen and U.S. Pat. Nos. 5,566,871 and 5,361,957 to Weintraub.

SUMMARY

One aspect of the invention relates to a strap having an extension element and a support element. The extension element has a pair of end portions defining a longitudinal axis extending between the end portions. The support element is secured to the extension element and has a first surface and an opposite second surface. In addition, the support element has a plurality of sipes that extend into the first surface and toward the second surface. At least a portion of the sipes extend through at least one-half of a distance between the first surface and the second surface.

Another aspect of the invention relates to a support element having a central area and a pair of end areas located on opposite sides of the central area. The central area is at least partially formed from a first polymer foam material, and the end areas area at least partially formed from a second polymer foam material. The first polymer foam material has greater compressibility than the second polymer foam material.

Yet another aspect of the invention relates to a support element with a first edge and a second edge that are substantially parallel to the longitudinal axis of the extension element. A thickness of the support element is greater at the first edge than the second edge to define a wedge-shaped cross-section in the support element.

The advantages and features of novelty characterizing various aspects of the invention are pointed out with particularity in the appended claims. To gain an improved understanding of the advantages and features of novelty, however, reference may be made to the following descriptive matter and accompanying drawings that describe and illustrate various embodiments and concepts related to the aspects of the invention.

DESCRIPTION OF THE DRAWINGS

The foregoing Summary, as well as the following Detailed Description, will be better understood when read in conjunction with the accompanying drawings.

DETAILED DESCRIPTION

The following material and accompanying figures disclose a strap that may be secured to various articles and utilized to assist in carrying the articles. The strap is disclosed in combination with a computer bag, but concepts associated with the strap may also be utilized in combination with a wide range of other bag styles, including backpacks, briefcases, camera bags, duffel bags, golf bags, handbags, messenger bags, and purses, for example. In addition to bags, concepts associated with the strap may be utilized in combination with a variety of other articles, including photographic equipment (i.e., cameras), binoculars, and various types of athletic equipment. Various harness configurations may also incorporate concepts associated with the strap, including seatbelts, hang gliding harnesses, parachuting harnesses, and horse tack, for example. An individual skilled in the relevant art will appreciate, therefore, that the concepts disclosed herein apply to strap configurations that are suitable for use with a variety of articles and for a wide variety of purposes.

Figure 1:
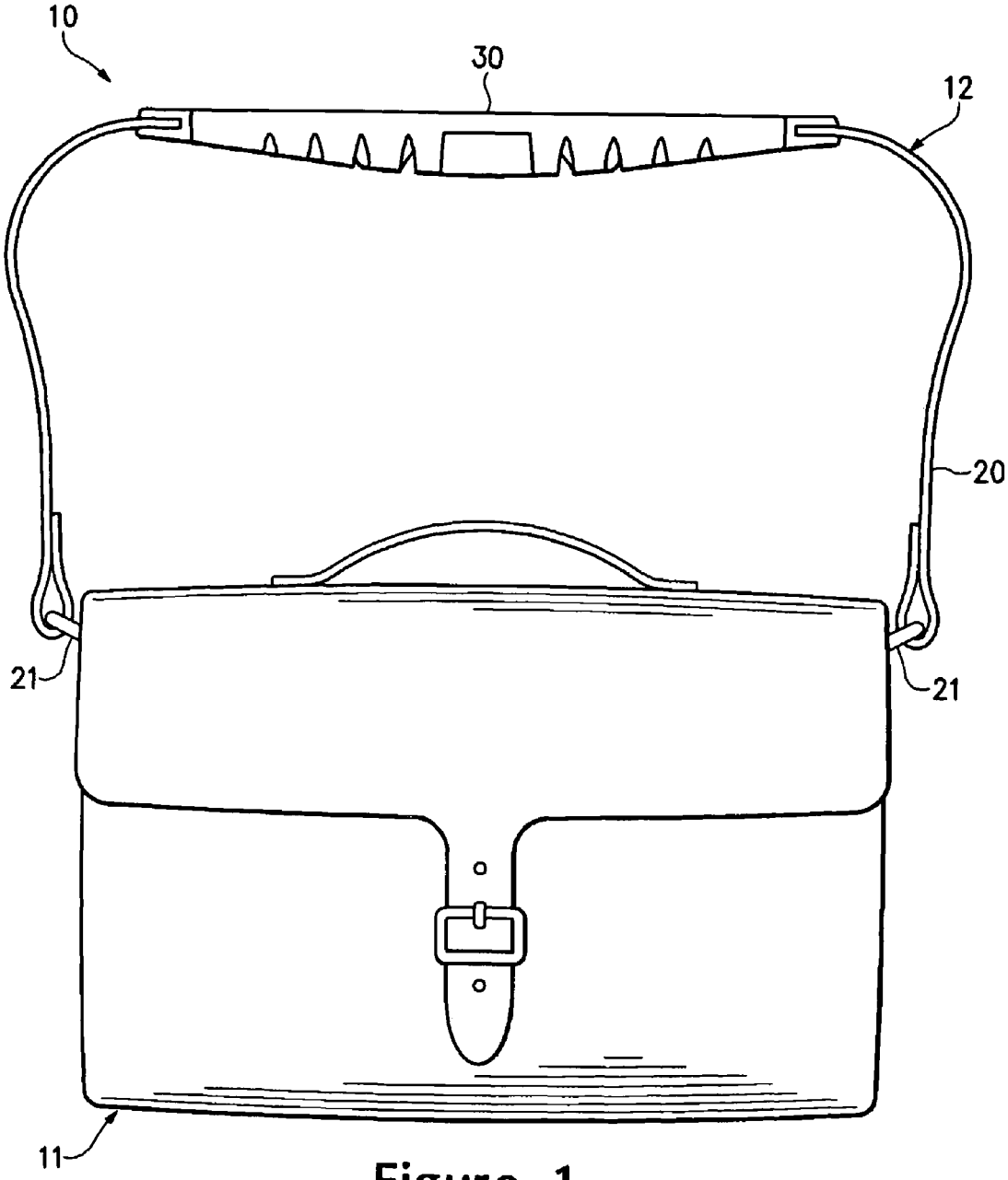
FIG. 1 is an elevational view of a bag incorporating a strap having an extension element and a support element.
Figure 2:
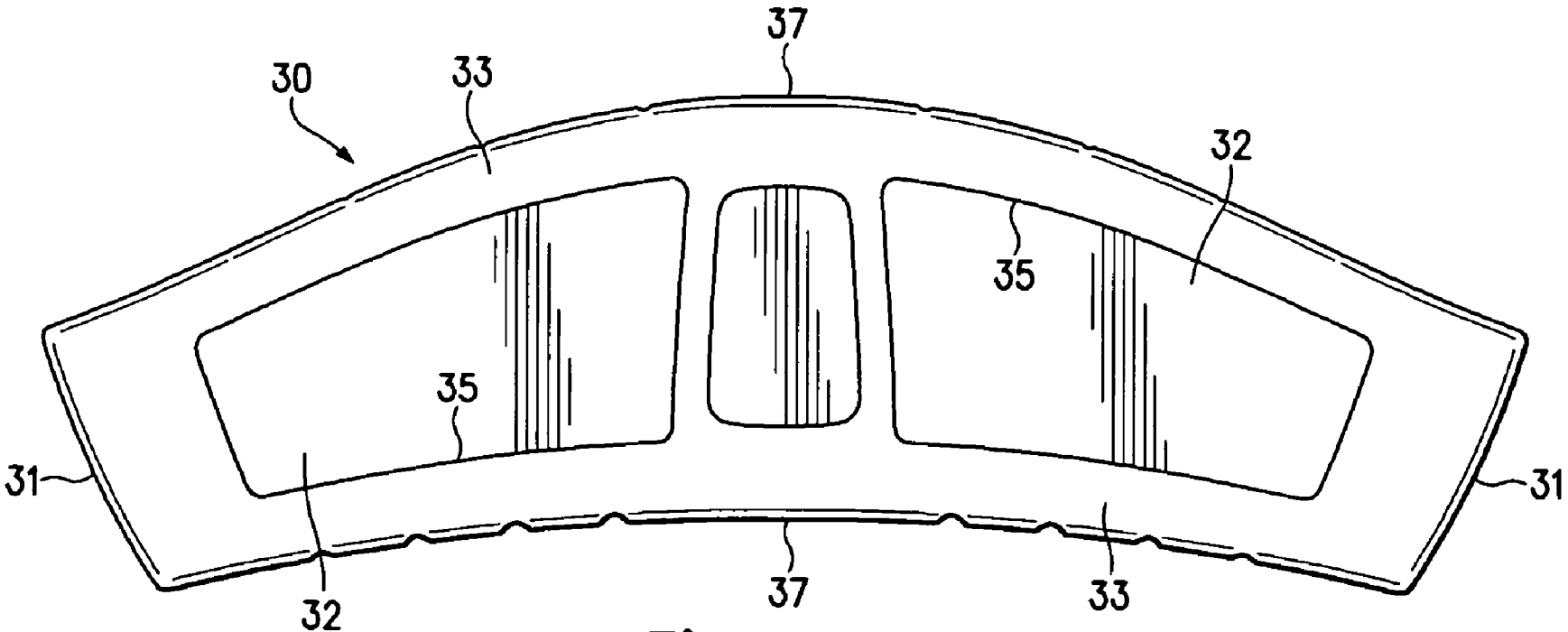
FIG. 2 is a top plan view of the support element.
Figure 3:
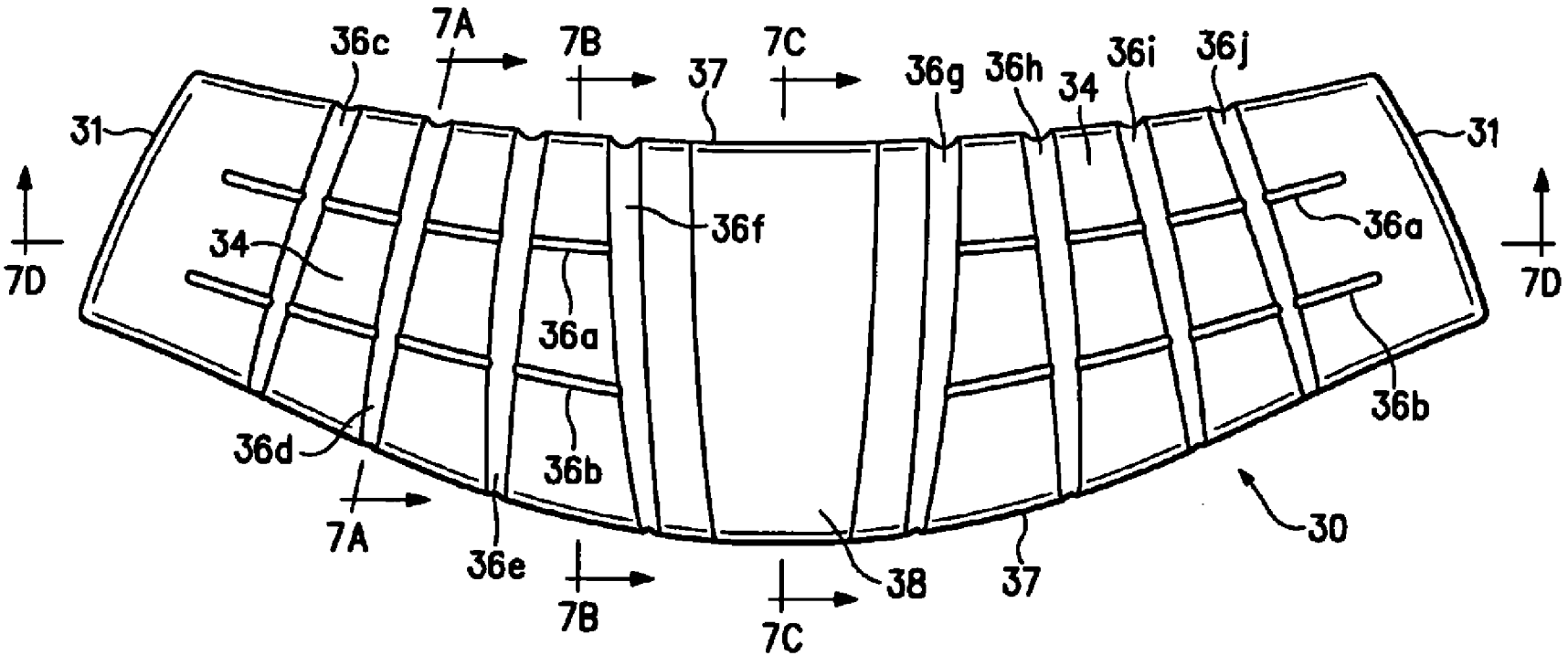
FIG. 3 is a bottom plan view of the support element.
Figure 4:
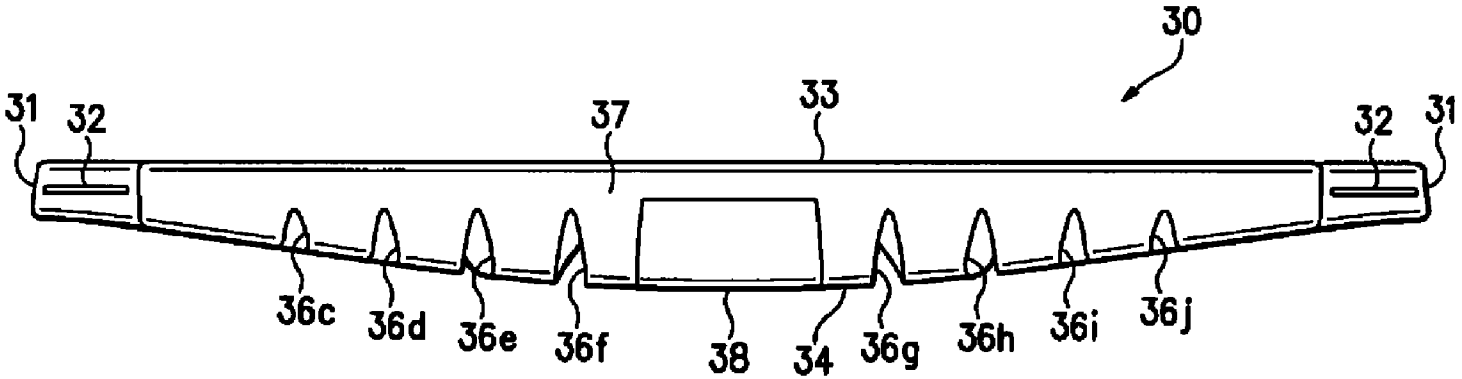
FIG. 4 is a front elevational view of the support element.
Figure 5:
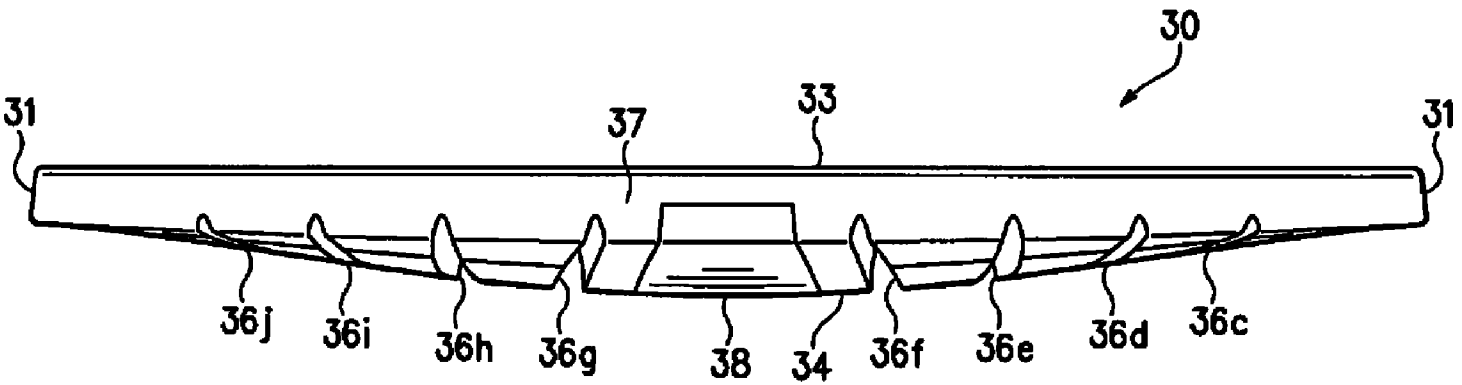
FIG. 5 is a rear elevational view of the support element.
Figure 6A:
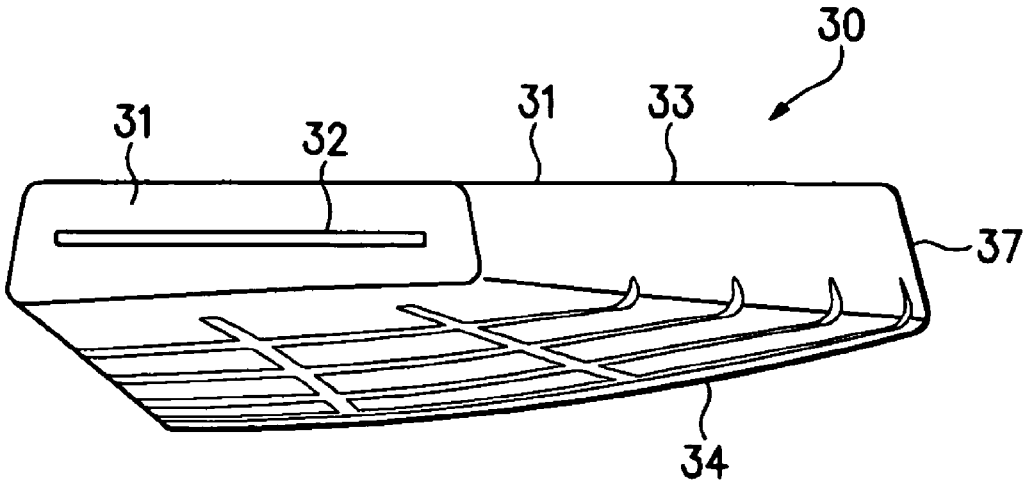
FIGS. 6A and 6B are side elevational views of the support element
Figure 6B:
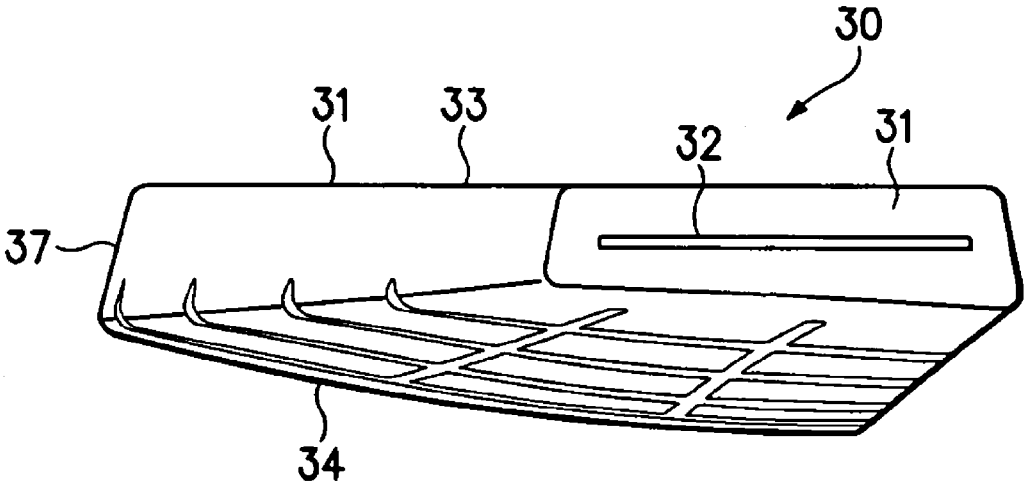
Figure 7A:
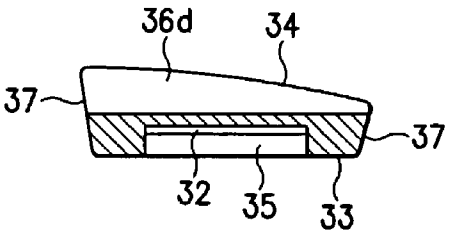
FIGS. 7A-7D are cross-sectional views of the support element, as defined by section lines 7A-7D in FIG. 3.
Figure 7B:
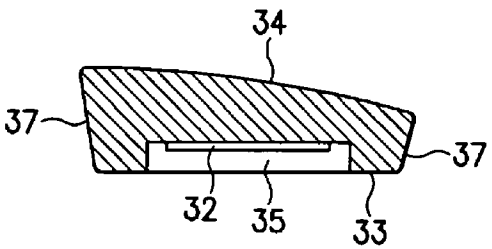
Figure 7C:
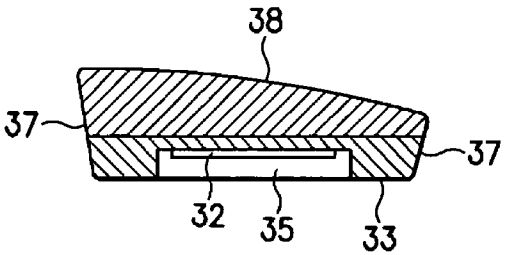
Figure 7D:
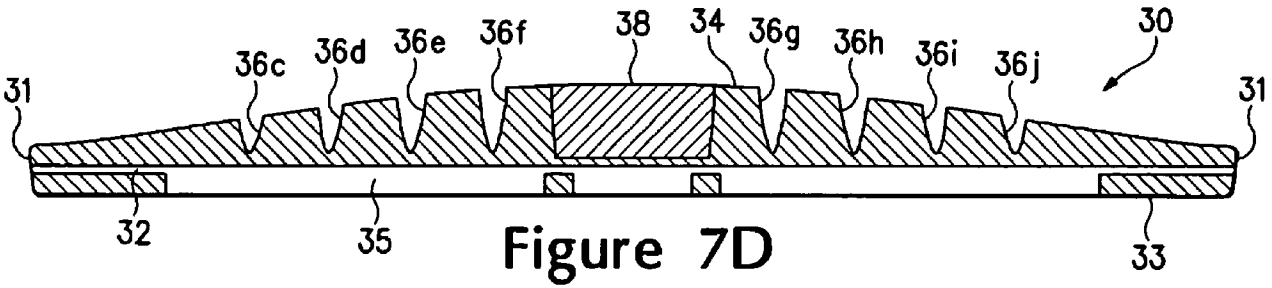

With reference to FIG. 1, a computer bag 10 is disclosed as including a container portion 11 and a carry strap 12. Bag 10 may be utilized to protect and transport various contents, including a notebook computer, accessories for the computer, and documents, for example. Accordingly, container portion 11 has a generally conventional configuration that is substantially hollow to accommodate the contents. Strap 12 is secured to container portion 11 in two locations to form a structure that extends over a shoulder of an individual, thereby permitting the individual to carry bag 10 and the contents. Although loop-style connectors are depicted, a variety of other connection styles may be utilized to secure strap 12 to container portion 11.

Strap 12 includes an extension element 20 and a support element 30. Extension element 20 is secured to container portion 11 in two locations and extends through support element 30. In use, support element 30 rests upon the shoulder of the individual and extension element 20 extends downward from opposite sides of the shoulder to form a tensile member that bears or otherwise supports the weight of container portion 11 and the contents of container portion 11. Support element 30 forms the primary point of contact between strap 12 and the individual, and distributes the weight of container portion 11 and the contents of container portion 11 over a surface of the individual. As discussed in greater detail below, support element 30 imparts cushioning properties to strap 12, thereby enhancing the comfort associated with carrying bag 10.

Extension element 20 extends through support element 30 and is movable with respect to support element 30. More particularly, extension element 20 and support element 30 are friction fit such that support element 30 is movable along the length of extension element 20. In further configurations, extension element 20 and support element 30 may be joined (e.g., with an adhesive, stitching, rivets) such that the positions of extension element 20 and support element 30 are fixed relative to each other. Either container portion 11 or end areas of extension element 20 includes generally conventional connectors 21 that securely join strap 12 to container portion 11. In some configurations, connectors 21 may be adjustable so that the functional length of extension element 20 may be modified by the individual. As depicted in FIG. 1, extension element 20 has a generally flat configuration and may be formed, for example, from nylon webbing. In further configurations, extension element 20 may be formed from a variety of other flexible materials, including rope, cord, chain or other structures capable of forming a tensile member that bears or otherwise supports the weight of container portion 11 and the contents of container portion 11. Accordingly, extension element 20 may exhibit a variety of configurations.

Support element 30 is depicted individually in FIGS. 2-7D as having an elongate shape that defines a pair of end areas 31. A channel 32 extends through support element 30 and between end areas 31 to receive extension element 20. That is, extension element 20 is secured to support element 30 by extending through channel 32, but other methods of joining extension element 20 and support element 30 may be utilized in further configurations of strap 12. An upper surface 33, which is located opposite a lower surface 34, defines various apertures 35 that expose areas of channel 32 and corresponding portions of extension element 20. In some configurations of support element 30, however, apertures 35 may be absent. Furthermore, a plurality of sipes 36*a*-36*j* extend into lower surface 34 and toward upper surface 33. Whereas sipes 36*a* and 36*b* extend between end areas 31 (i.e., in a direction that is substantially parallel to a longitudinal axis of extension element 20), sipes 36*c*-36*j* extend between a pair of edges 37 (i.e., in a direction that is substantially perpendicular to the longitudinal axis of extension element 20).

Sipes 36*a*-36*j* are generally elongate indentations in lower surface 34 that define various flexion lines in support element 30. Depending upon the manufacturing method for support element 30, sipes 36*a*-36*j* may be depressions, incisions, cuts, or other structures that form an elongate indentations in lower surface 34. In general, sipes 36*a*-36*j* reduce the overall thickness of support element 30 along specific lines, and the reduced thickness enhances the flexibility of support element 30 along those lines. Accordingly, sipes 36*a* and 36*b* enhance the flexibility of support element 30 between edges 37, and sipes 36*c*-36*j* enhance the flexibility of support element 30 between end areas 31.

As discussed above, sipes 36*a* and 36*b* extend in a direction that is substantially parallel to a longitudinal axis of extension element 20, and sipes 36*c*-36*j* extend in a direction that is substantially perpendicular to the longitudinal axis of extension element 20. In some configurations of support element 30, various sipes may also extend diagonally or in directions that depart from being substantially parallel and substantially perpendicular to the longitudinal axis of extension element 20. That is, the directions of flex in support element 30 that are imparted through the formation of sipes may vary significantly.

The depth of sipes 36*a*-36*j* (i.e., the degree to which sipes 36*a*-36*j* extend between surfaces 34 and 33) has an effect upon the flexibility of support element 30. In general, a greater depth for sipes 36*a*-36*j* imparts greater flexibility, whereas a lesser depth for sipes 36*a*-36*j* imparts lesser flexibility. Although the depth of the sipes 36*a*-36*j* may vary significantly, a portion of sipes 36*a*-36*j* are depicted as extending through at least one-half of a distance between the lower surface 34 and upper surface 35. That is, some of sipes 36*a*-36*j* may extend through more than one-half of the thickness of support element 30.

Support element 30 may be formed from a variety of materials, including polymer foam materials. More specifically, suitable foam materials include, for example, polyurethane and ethylvinylacetate. Although an entirety of support element 30 may be formed from a polymer foam material, various reinforcing elements may be incorporated into support element 30. For example, the portions of channel 23 adjacent end areas 31 may have polymer reinforcing members that prevent extension element 20 from inducing stretching or wear in end areas 31. Securing members may also be incorporated into support element 30 to permanently or semi-permanently secure the position of support element 30 with respect to extension element 20. Attachment members may also be incorporated into support element 30 to, for example, provide an area for attaching a case for a cell phone or digital music player. In some configurations, a fluid-filled bladder may be incorporated into support element 30 to enhance the cushioning properties of strap 12.

A single polymer foam material may be utilized for each area of support element 30. As an alternative, support element 30 may be formed from a plurality of polymer foam materials with different properties. For example, a polymer foam material with greater density may be utilized to reinforce the portions of channel 32 that are adjacent end areas 31. Portions of support element 30 that are adjacent to lower surface 34 may be formed from a polymer foam material with greater compressibility than portions of support element 30 that are adjacent to upper surface 33, thereby locating a softer foam in areas that contact the individual. Furthermore, portions of lower surface 34 corresponding with a central area 38 (i.e., an area between sipes 36*f* and 36*g*) may be formed from a foam material with greater compressibility to locate a relatively soft material in areas of the suprascapular nerve. As an example, a majority of support element 30 may be formed from a polyester or polyurethane foam with a hardness of approximately 45 on the Asker C scale, and central area 38 may be formed from a polyester or polyurethane foam with a hardness of approximately 25 on the Asker C scale. Accordingly, multiple polymer foam materials may be injected into a mold in the formation of support element 30.

Although upper surface 33 and lower surface 34 may be substantially parallel to each other, the cross-sections of FIGS. 7A-7D depict upper surface 33 and lower surface 34 has being non-parallel to each other. That is, support element 30 has a first thickness along one of edge 37 and a lesser second thickness along the other edge 37. This configuration forms a wedge-shaped cross-section in support element 30 when the cross-section is taken between edges 37 (i.e., in a direction that is substantially perpendicular to the longitudinal axis of extension element 20).

Figure 8A:
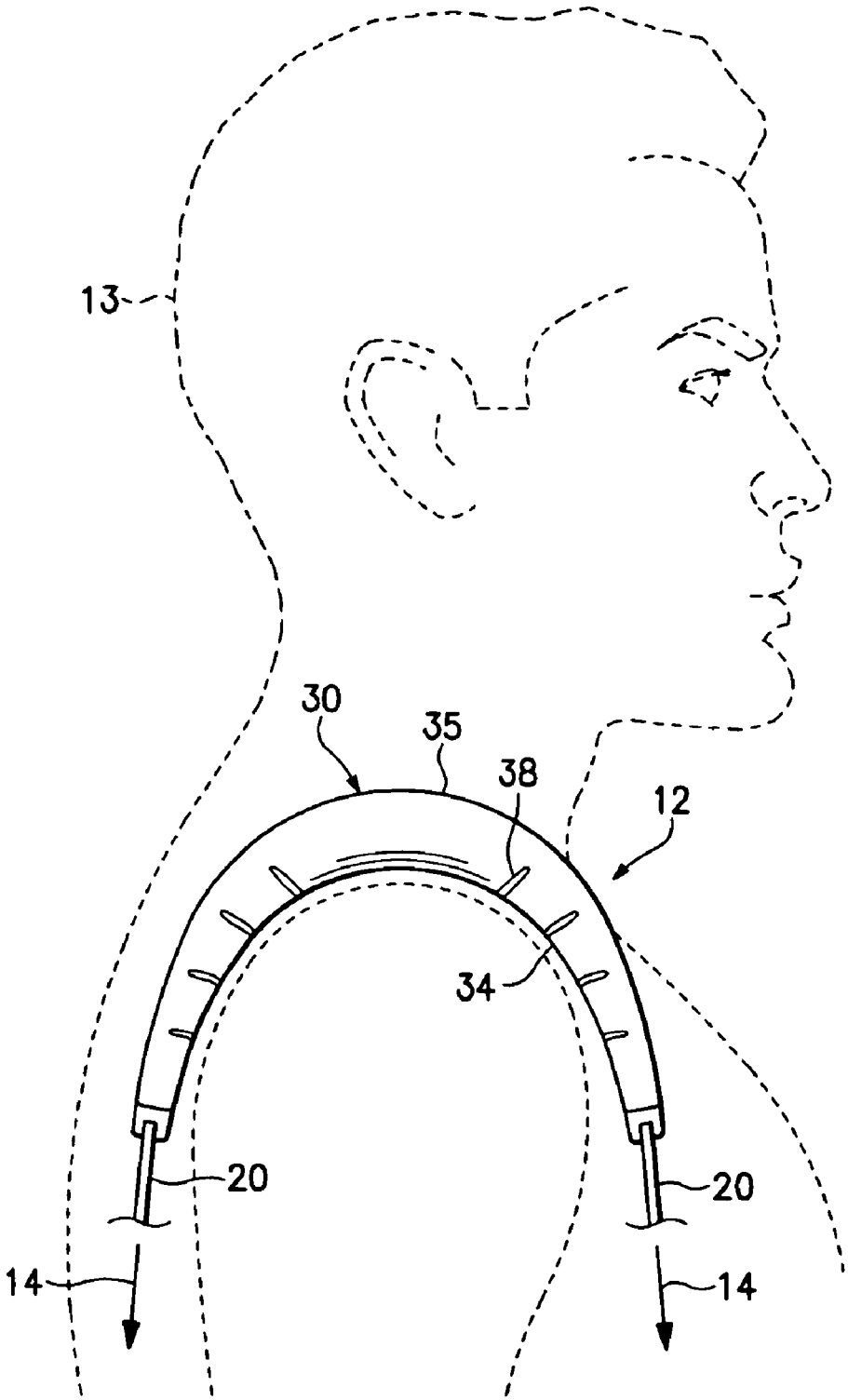
FIGS. 8A and 8B are a schematic elevational views of the strap extending over a shoulder of an individual.
Figure 8B:
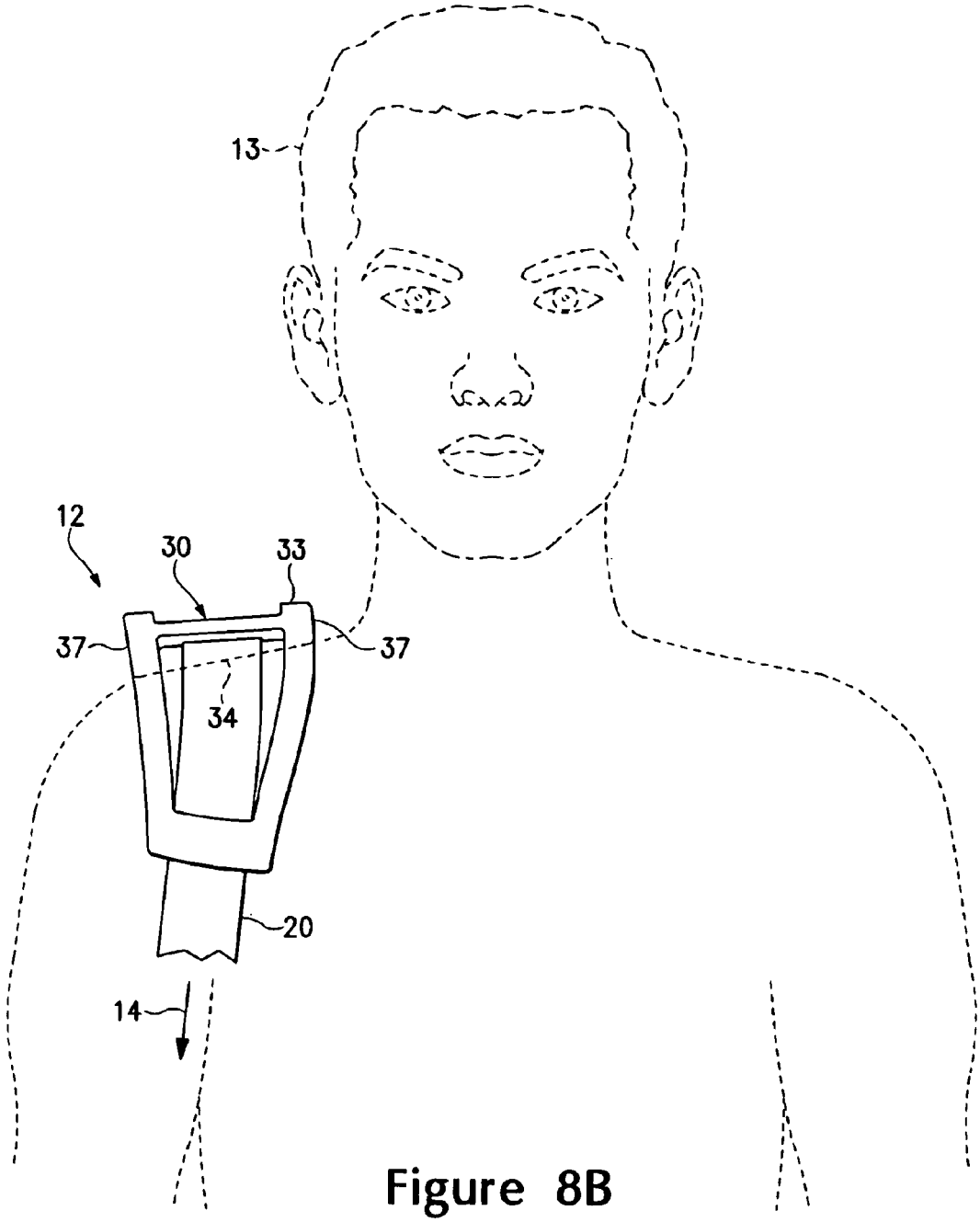

Strap 12 is schematically-depicted as extending over and resting upon the shoulder of an individual 13 in FIGS. 8A and 8B. Extension element 20 is secured to container portion 11 and is, therefore, in tension due to the combined weight of container portion 11 and the contents of container portion 11. That is, the combined weight of container portion 11 and the contents of container portion 11 induces a tensile force in extension element 20, which is represented by arrows 14. The tensile force causes strap 12 to flex and conform with the shape of the shoulder. More particularly, the tensile force causes extension element 20 to press downward upon support element 30, and support element 30 flexes at sipes 36*a*-36*j* to conform with the shape of the shoulder. In general, the greater the area of contact between support element 30 and the shoulder, the greater the combined weight of container portion 11 and the contents of container portion 11 is distributed over the shoulder. Accordingly, the flexibility of support element 30, which is at least partially due to the presence of sipes 36*a*-36*j*, enhances the weight distribution on the shoulder, thereby increasing the comfort of carrying bag 10.

With regard to the shoulder, the suprascapular nerve extends from the neck to an end of the shoulder, and the suprascapular nerve is generally located along an upper area of the shoulder. As depicted in FIG. 8A, the position of the suprascapular nerve coincides with the position of central area 38. As discussed above, central area 38 may be formed from a foam material with greater compressibility to locate a relatively soft material in areas of the suprascapular nerve. Accordingly, this configuration for strap 12 enhances the comfort of carrying bag 10 by decreasing the force applied to areas of the shoulder having the suprascapular nerve.

As noted above, support element 30 has a wedge-shaped cross-section. With reference to FIG. 8B, the shoulder is depicted as having a downward slope. In combination with the wedge-shaped cross-section, upper surface 33 is substantially horizontal. This configuration may assist with preventing strap 12 from slipping from the shoulder during the use of bag 10.

The invention is disclosed above and in the accompanying drawings with reference to a variety of embodiments. The purpose served by the disclosure, however, is to provide an example of the various features and concepts related to aspects of the invention, not to limit the scope of aspects of the invention. One skilled in the relevant art will recognize that numerous variations and modifications may be made to the embodiments described above without departing from the scope of the invention, as defined by the appended claims.

That which is claimed is:

1. A strap, comprising:

an extension element having a pair of end portions and defining a longitudinal axis extending between the end portions; and a support element secured to the extension element, the support element having a first surface and an opposite second surface, wherein the first surface is configured to contact a wearer of the strap, the support element having a plurality of sipes that extend into the first surface and toward the second surface, wherein the sipes comprise elongate indentations in the first surface and define one or more flexion lines in the support element, the sipes including a first sipe extending in a direction that is substantially parallel to the longitudinal axis of the extension element, and the sipes including a second sipe intersecting the first sipe and extending in a direction that is substantially perpendicular to the longitudinal axis of the extension element and wherein at least a portion of the first sipe and at least a portion of the second sipe extend through at least one-half of a distance between the first surface and the second surface, wherein the first surface has a pair of end areas and a central area disposed between the pair of end areas, the central area being at least partially formed from a first polymer foam material, and the end areas being at least partially formed from a second polymer foam material, the first polymer foam material having greater compressibility than the second polymer foam material and wherein a material composition of the central area is different from a material composition of the pair of end areas, and wherein the support element is entirely formed from polymer foam material.

2. The strap recited in claim 1, wherein the support element defines a channel extending between the pair of end areas of the support element, and the extension element extends through the channel.

3. The strap recited in claim 1, wherein the support element has a first edge and a second edge that are substantially parallel to the longitudinal axis of the extension element, the support element having a first thickness along the first edge, and the support element having a second thickness along the second edge, the first thickness being greater than the second thickness.

4. The strap recited in claim 1 wherein the first surface slopes relative to the second surface to define a wedge-shaped cross-section in the support element, the cross-section being substantially perpendicular to the longitudinal axis of the extension element.

* * * * *